US006689224B1

(12) United States Patent
Hillman

(10) Patent No.: US 6,689,224 B1
(45) Date of Patent: Feb. 10, 2004

(54) IMPLEMENT AND METHOD FOR PERSONAL HYGIENE

(76) Inventor: Rosemary Hillman, 39292 Montana Dr., Romulus, MI (US) 48174

( * ) Notice: Subject to any disclaimer, the term of this patent is extended or adjusted under 35 U.S.C. 154(b) by 0 days.

(21) Appl. No.: 10/366,599

(22) Filed: Feb. 13, 2003

Related U.S. Application Data

(60) Provisional application No. 60/356,382, filed on Feb. 13, 2002.

(51) Int. Cl.[7] ..... B08B 1/00
(52) U.S. Cl. ..... 134/6; 15/210.1; 604/1
(58) Field of Search ..... 15/209.1, 210.1; 604/1; 134/6

(56) References Cited

U.S. PATENT DOCUMENTS 5,044,040 A * 9/1991 Tetrault
6,272,716 B1 * 8/2001 Thornton

* cited by examiner

*Primary Examiner*—Randall E. Chin
(74) *Attorney, Agent, or Firm*—John R. Benefiel

(57) ABSTRACT

An implement used for personal hygiene by an obese or impaired person includes an elongated handle having a curving blade covered with an absorbent wiping cover, stroked by the user gripping the handle with the covered blade pressed against the person's anal-genital body regions.

1 Claim, 1 Drawing Sheet

IMPLEMENT AND METHOD FOR PERSONAL HYGIENE

CROSS REFERENCE TO RELATED APPLICATION

This application claims the benefit of U.S. provisional Ser. No. 60/356,382, filed Feb. 13, 2002.

BACKGROUND OF THE INVENTION

This invention concerns personal hygiene and in particular cleaning of the anal and genital regions of a person's body while seated on a toilet. Such cleaning is of course usually carried out with hand held wads of toilet paper. Obese or physically impaired persons often have difficulty reaching this region of the body.

Various implements have been proposed for the assisting such persons in accomplishing such personal hygiene. U.S. Pat. Nos. 5,862,564; 6,272,716 B1 and 5,044,040 all describe implements which allow a person to more easily reach this body region with cleaning fabric or toilet paper and eliminate hand holding of such cleaning paper or fabric.

Such implements however are not configured to easily allow such cleaning to be carried out and/or are not effective in cleaning that region of the body but rather are difficult to use and/or do not properly contact the anal-genital regions to obtain effective cleaning pressure.

Rather the shapes of these prior devices require awkward motions of a person's arms; and do not conform to the body contours necessary to obtain good and complete rubbing pressure over the entire region for effective cleaning.

SUMMARY OF THE INVENTION

It is the object of the present invention to provide an implement for allowing personal hygiene to be effectively maintained in an improved manner.

This object and other objects which will become apparent upon a reading of the following specification and claims are achieved by an implement shaped to enable easily executed cleaning strokes while maintaining good pressure contact with body regions to be cleaned.

The implement has a long handle with a wider curved blade portion at one end, the handle a flat blade of a length on the order of twelve inches or so. The curved blade portion has a flat spoon shape which gently curves up out of the plane of the handle to extend obliquely therefrom and terminating in a rounded point. The curved blade portion has a cover of absorbent sheet material installed thereon.

By grasping the handle the implements curved blade portion can easily be positioned over the anal-genital regions. The curved shape and oblique inclination causes the curved blade portion to be in complete contact with these regions to allow effective cleaning by stroking of the implement without injuring the user. The handle is positioned in a generally vertical position at this time so that stroking motions are easily executed by the user.

DETAILED DESCRIPTION

Figure 1:
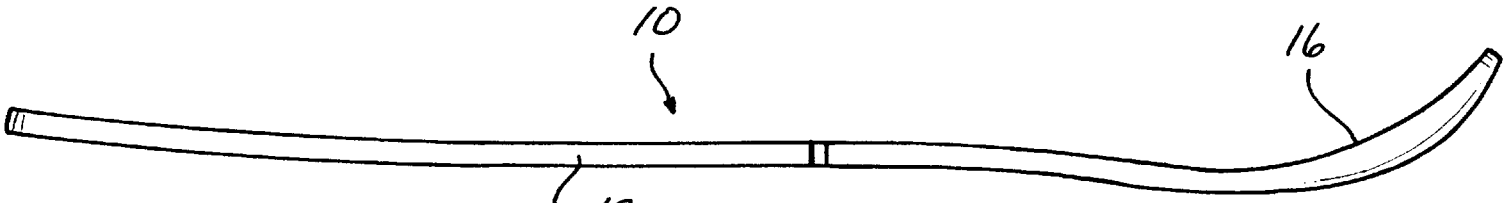
FIG. 1 is a side elevational view of the implement according to the present invention.
Figure 2:
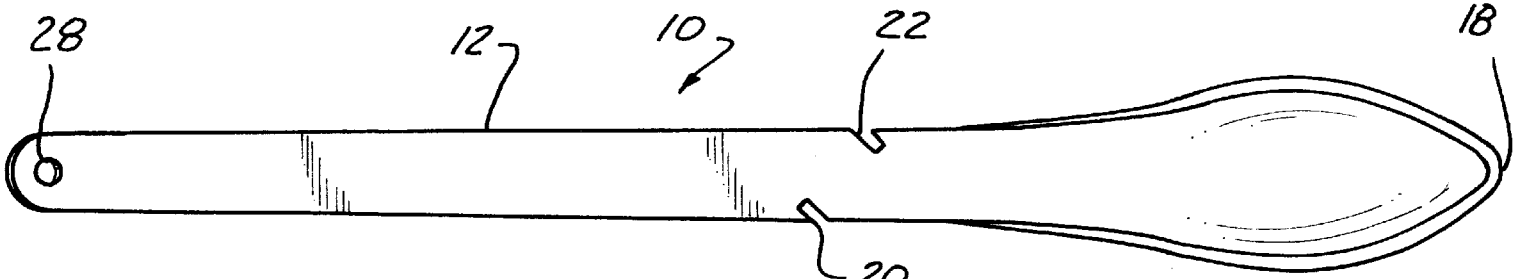
FIG. 2 is a plan view of the implement according to the invention.
Figure 3:
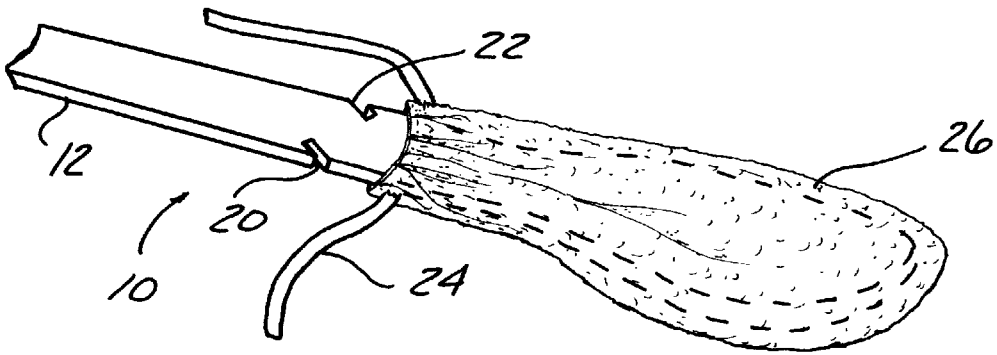
FIG. 3 is an enlarged fragmentary perspective view of the end portion of the implement according to the invention of the implement having a cover partially installed thereon.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, an implement 10 according to the invention is shown, which may be constructed of a suitably strong and able to be sanitized plastic such as nylon or polypropylene, having all smoothed rounded edges so as to not injure the skin or a user when rubbed against the same. A smooth metal construction is also possible, such as stainless steel, but plastic is preferred due to its warm feel, easy washability, and low cost.

The implement 10 includes a relatively long elongated handle portion 12, normally of a length on the order of approximately one foot, although substantially longer lengths can be provided, as for very large persons.

The width and thickness of the handle depend on the material used, but would be around ¾" wide and ⅜" thick when made of plastic material.

The handle 12 can be slightly bent or curved at one end as shown in FIG. 1.

A widened curved blade portion 16 is integral with the opposite end of the handle 12. The wider blade portion 16 is of a gently upwardly curving configuration to extend obliquely from the handle 12 and having a spoon-like but flattened shape, without a bowl. A blunted rounded tip 18 is at the very distal end.

The handle 12 is notched on respective sides. The notches 20, 22 may be used to secure a lacing 24 for a wiping cover 26 enclosing the curved blade portion 16. An elastic band can also be used instead of a lacing to retain the wiping cover in place.

The wiping cover 26 is comprised of a pliant absorbent sheet material such as a multilayer soft tissue paper.

In use, the implement 10 is manipulated to bring the blade portion 16 in position in an orientation to curve up around in general conformity with the anal-genital regions. By exerting a lateral pushing force on the handle 12, the blade portion 16 is held against these regions, and a front to rear wiping motion will be produced by up and down stroking of the implement. The smooth rounded contours prevent injury or discomfort.

Contact pressure can be effortlessly maintained during stroking to easily achieve an effective cleaning action.

The wiping cover 26 can simply be disposed of in the usual manner.

The implement 10 itself can easily be washed off and a new cover installed to be ready for the next use.

The implement 10 can also be provided with a hole 28 in the one end of the handle 12 for handing at a convenient location.

The implement 10 while intended for use by an impaired or obese person, can also be used by any person to avoid contamination with fecal matter.

In addition, it can be used in washing other hard to reach body areas, as when showering.

What is claimed is:

1. A method of cleaning the anal-genital regions of a person's body while the person is seated on a toilet seat comprising the steps of:

gripping one end of an elongated handle of an implement with one of the user's hands and positioning the handle to extend beneath the anal-genital regions of the person's body;

positioning a curving blade portion of said implement extending from the other end of the handle over the anal-genital regions with the curvature in general conformity with the anal-genital regions, said curving blade portion having an absorbent wiping cover thereon; and, stroking said implement in a generally lengthwise direction while pressing said covered blade portion against said anal-genital regions of the user's body.

* * * * *